United States Patent [19]

Boissevain

[11] Patent Number: 4,977,687

[45] Date of Patent: Dec. 18, 1990

[54] DRIP FREE STEAMBOX

[75] Inventor: Mathew G. Boissevain, Los Altos, Calif.

[73] Assignee: Measurex Corporation, Cupertino, Calif.

[21] Appl. No.: 227,996

[22] Filed: Aug. 3, 1988

[51] Int. Cl.[5] ..... F26B 21/06

[52] U.S. Cl. ..... 34/51; 34/16; 34/23; 34/160; 162/207; 162/290

[58] Field of Search ..... 162/207, 290, 375; 34/160, 23, 51, 155, 16

[56] References Cited

U.S. PATENT DOCUMENTS

| | | | |
|---|---|---|---|
| 3,777,781 | 12/1973 | Dove | 162/290 X |
| 4,253,247 | 3/1981 | Bergstrom . | |
| 4,320,583 | 3/1982 | Dove | 34/160 X |
| 4,358,900 | 12/1982 | Dove | 162/207 X |
| 4,543,737 | 10/1985 | Boissevain . | |
| 4,580,355 | 4/1986 | Boissevain . | |
| 4,671,173 | 6/1987 | Boissevain . | |
| 4,765,067 | 8/1988 | Taylor | 34/23 |
| 4,786,529 | 11/1988 | Boissevain | 427/296 |

FOREIGN PATENT DOCUMENTS

| | | | |
|---|---|---|---|
| 88/04395 | 6/1988 | World Int. Prop. O. | 34/155 |

*Primary Examiner*—Albert J. Makay
*Assistant Examiner*—John Sollecito
*Attorney, Agent, or Firm*—Spensley, Horn, Jubas & Lubitz

[57] ABSTRACT

The specification discloses a steambox for assisting in the drying of sheet material. The steambox has a means for preventing steam which condenses inside the steambox plenum from dripping onto the sheet. The steam is jetted from the plenum toward the sheet through a single cross-directionally oriented slot to decrease entrainment of ambient air and thereby increase heating efficiency.

25 Claims, 3 Drawing Sheets

DRIP FREE STEAMBOX

BACKGROUND OF THE INVENTION

The present invention relates to a type of steam distributor known as a "steambox" which is used in the manufacture of sheet materials, and in particular, to a steambox design that increases the production rate of paper sheet while decreasing energy utilization. Even more particularly, the present invention relates to a steambox design which substantially eliminates undesirable dripping of condensation onto the paper sheet from the steambox itself and from adjacent structures.

One of the parameters used in grading sheet materials is the moisture content of the material. For example, in the paper production process, various grades of paper having different moisture contents are produced to suit various applications.

Paper production begins with a wet mass of fibers and typically involves several drying processes, the first of which includes impinging the paper sheet material with steam from a steambox and may also include drawing the steam through the sheet with a vacuum box to improve heat transfer from the steam to the sheet. This steam treatment, for example, may cause an increase in sheet temperature of approximately 30° C. The increased temperature decreases the viscosity of water in the sheet. At a later point in the papermaking process, water is squeezed and/or suctioned out of the paper sheet in a section of the papermaking machinery known as the "press section". Because the steam heats the water, the water viscosity is decreased, and thus the pressing and suctioning of water out of the sheet is rendered more effective. In still later drying steps, the sheet is typically passed over several heated steel drums, in the so-called "drying section" of the papermaking machine, to further reduce the moisture content of the sheet. The resulting increase in the dryness of the sheet as it leaves the press section permits an increase in the sheet production rate, as drier paper can move more rapidly through the subsequent drying section.

In the production of many paper products, it is desirable to automatically control the "cross-directional" (i.e., the direction across the width of the sheet perpendicular to the direction of sheet movement) moisture content of the paper sheet using a steambox. Many papermaking machines have scanning moisture sensors which continuously scan back and forth across the width of the sheet and sense the sheet moisture content at various locations across the sheet as the paper is manufactured. The information from this continuous moisture measurement can be fed into a controlling computer. The computer then controls the amount of steam applied by the steambox to various locations across the width of the sheet based upon the sensed moisture content.

Examples of steam distributors are shown in U.S. Pat. Nos. 4,253,247 and 4,580,355, which are incorporated herein by reference. These patents teach a multi-chambered steam distributor in which steam flows from a steam pipe through a valve associated with each chamber, into each chamber, and then is directed to the section of the sheet adjacent to each chamber. The steam flow out of each chamber and toward an adjacent sheet section is controlled by progressively opening or closing the associated valve.

FIG. 1 illustrates an example of a known process in which the present invention may be applied. In particular, FIG. 1 shows a papermaking machine including a steambox 10 to assist in drying the sheet 8. The papermaking machine shown is of the Fourdrinier type and includes a head box 2 feeding a pulp and water mixture 4 to a porous conveyer belt called a "wire" 6 through which the water is drained from the pulp. The paper sheet 8 travels under the steambox 10 and over a vacuum box 12, which, as previously mentioned, assists in drawing the steam through the sheet 8. FIG. 1 also shows an alternate position "A" where the steambox 10 may also be located.

After passing under the steambox 10, the sheet then passes through the press section 14, including pressure rollers 15 and absorbent material 17, further dryers (not shown) and a known scanning moisture sensor 16 which, as previously mentioned, measures the moisture content of the sheet at various locations across the width of the sheet 8. The amount of steam jetted from the steambox 10 at various cross-directional locations is adjusted manually or automatically to reduce the moisture variations in the cross-direction of the sheet 8. As more steam is jetted from a particular steambox chamber onto an opposing section of the sheet, that sheet section becomes hotter and the water viscosity in that sheet section decreases; therefore, the more effectively water may be removed from the hot sheet section. In other words, the use of more steam results in a drier sheet section.

A common problem encountered in altering the moisture content of the sheet via steam treatment is that excess steam that has not been absorbed by the sheet may condense on cool surfaces of the adjacent structures of the paper processing machinery and then drip onto the sheet. The sheet thus moistened will then bear an unsightly water mark. Moreover, this wet portion is weaker than the rest of the sheet and is therefore unusually subject to tearing.

Another shortcoming of the prior art is the use of diffusion plates, which generally contain a large number of small openings through which steam is jetted from the steambox onto the paper sheet. When steam is ejected through these numerous openings, especially numerous small openings, the large quantity of surface area of the steam entrains a relatively large volume of ambient air, which cools the steam before it contacts the sheet; thus, the sheet is not heated as efficiently or as much, and condensation is more likely to occur.

In addition, to the best of applicant's knowledge, the prior art fails to address or remedy the problem of condensation formation within the steambox itself; this condensate could easily drip out of the openings in the diffusion plate and onto the sheet. Such an occurence is particularly troublesome when the machinery is first started up and the steambox is cold.

To overcome the shortcomings of the prior art, it will be appreciated that it is desirable to apply steam to a paper sheet in a manner that will increase the temperature of the sheet while producing a resultant decrease in the viscosity of the water contained in said sheet; this combination of increased heat and decreased viscosity will greatly facilitate immediate and subsequent removal of water from the sheet via a pressing and/or a suctioning process. It will also be appreciated that a steam treatment method that reduces the amount of condensation on the equipment in close proximity to the sheet and that eliminates dripping of water from inside the steambox will reduce the possibility of tearing the sheet, and will also reduce unsightly water marks.

SUMMARY OF THE INVENTION

The present invention is directed toward a steambox designed for efficient steam heating of a paper sheet while reducing or eliminating drippage from the steambox, condensation of steam upon adjacent surfaces of the papermaking machine, and upon the steambox itself.

The steambox includes an elongated steam plenum which preferably, but not necessarily, extends across the entire width of a sheet which is moving through the papermaking machine. One wall of the plenum is disposed in close facing proximity to the moving sheet. A single cross-directionally oriented steam exit slot is formed in this wall for directing steam from the steambox toward the sheet.

The interior of the plenum is divided into chambers, each of which extends across less than the entire width of the sheet. A steam valve is associated with each chamber for selectively controlling the flow of steam from a steam supply pipe into each steam chamber and subsequently out of the slot toward the sheet.

Use of a single steam slot increases the heating efficiency of the steam, as the steam ejected from the single slot entrains less ambient air (and thus cools less rapidly) than the same volume of steam ejected from numerous smaller openings. Further, this increased heating efficiency results in the formation of less condensate, as the surface of the steambox adjacent the sheet and the paper sheet itself are hotter. By opening and closing the steam valve associated with any selected chamber, more or less steam can be directed through the slot at the cross-directional sheet section adjacent to the selected chamber.

Another significant improvement over the prior art consists of the use of "dam walls" positioned inside the plenum at the anterior and posterior sides of the steam exit slot. The dam walls prevent water which has condensed inside the plenum chamber from dripping out of the exit slot and onto the sheet. Drainage holes positioned on both sides of the steam exit slot allow the condensate to be drained away from inside the plenum and thus function to prevent the leakage of condensate from the slot onto the paper sheet.

The moisture content of the sheet may be monitored and compared to a desired moisture content, and the steam valves are activiated accordingly. For example, a known type of moisture sensor may be positioned at a location downstream of the steambox on the papermaking machine. The moisture sensor is scanned back and forth across the width of the sheet and generates signals indicative of the sheet moisture content at various locations across the sheet. The moisture signals are then transmitted to a computer. The computer is programmed to selectively open and close the steam valves assocated with each chamber to achieve the desired sheet moisture content. For example, if a sheet section is too moist, the computer will open the valve associated with the chamber disposed over the moist sheet section. Conversely, if a sheet section is too dry, then the computer will close the steam valve associated with the chamber over the dry sheet section. Depending upon the amount of excess moisture in the sheet sections or the dryness of the sheet sections, the valves can be completely opened or closed, or partially opened or closed to achieve the desired sheet moisture profile.

DETAILED DESCRIPTION OF THE PREFERRED EMBODIMENT

The following description is of the best presently contemplated mode of carrying out the invention. This description is made for the purpose of illustrating the general principles of the invention and should not be taken in a limiting sense. The scope of the invention is best determined by reference to the appended claims.

Figure 2:
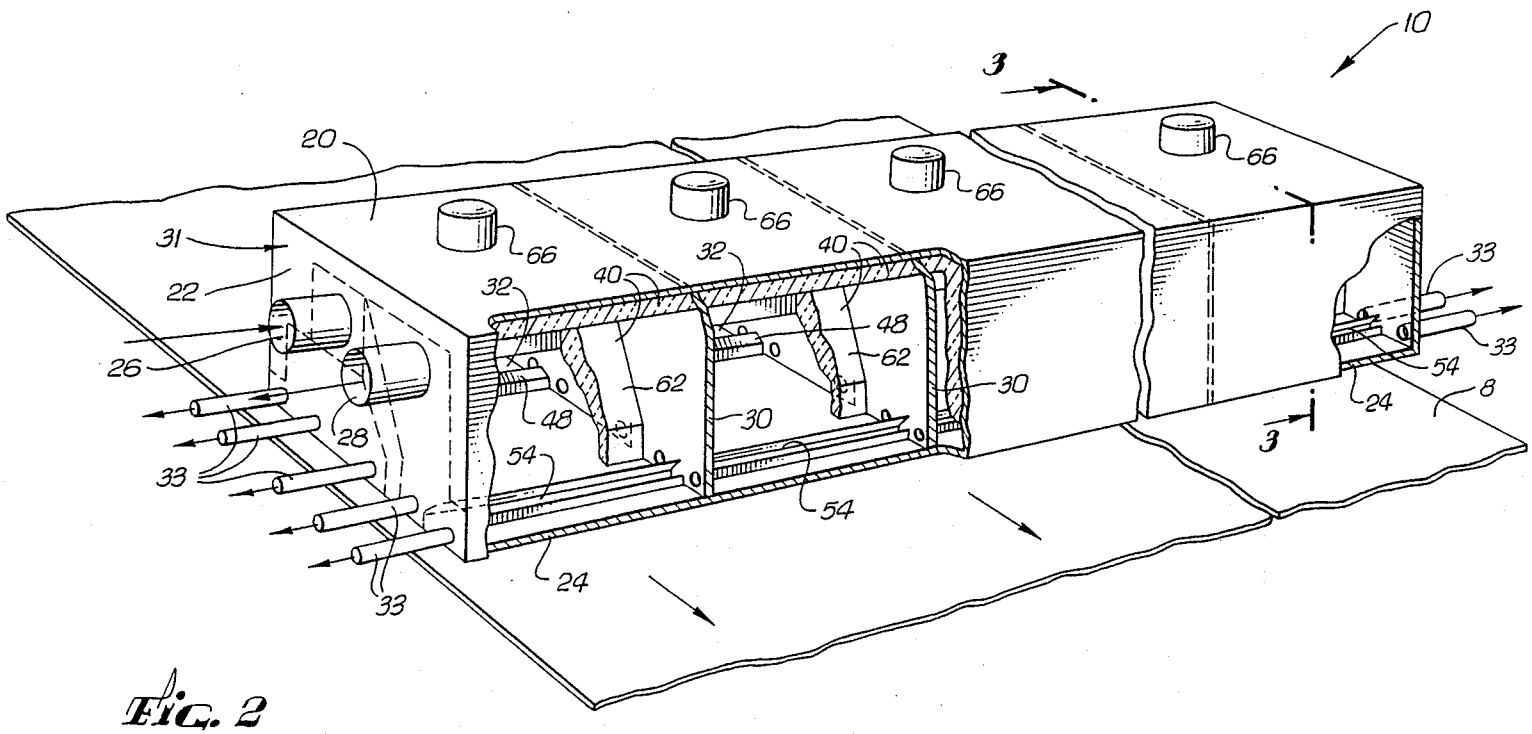
FIG. 2 is a perspective view of one presently preferred embodiment of a steambox according to the present invention.
Figure 3:
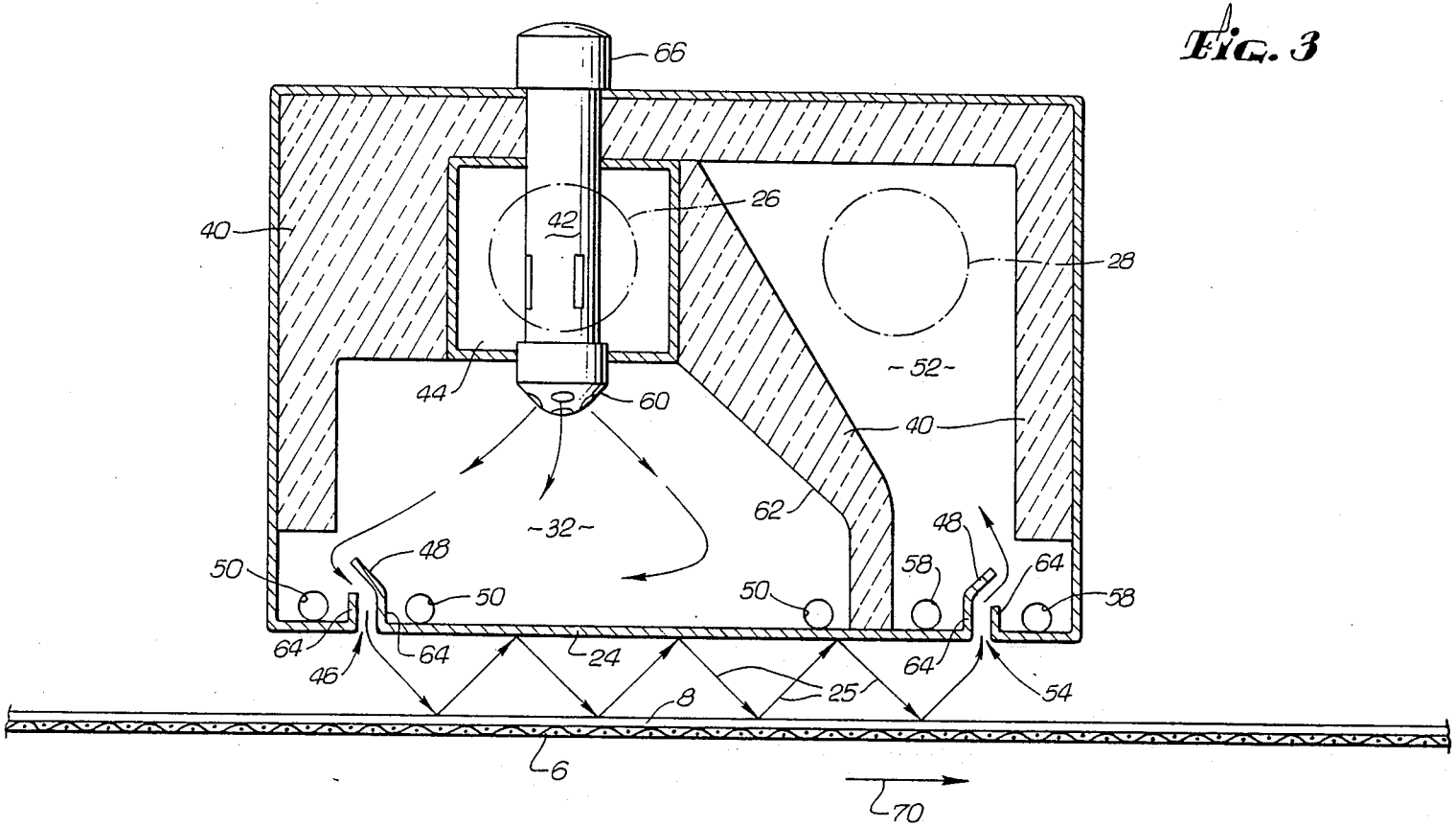
FIG. 3 is a cross-sectional illustration of the embodiment shown in FIG. 2 taken along line 3—3.

FIGS. 2–3 illustrate a presently preferred embodiment of the steambox 10 of the present invention. In this embodiment, the steambox 10 is lined with insulation 40 on various interior surfaces to increase the heating efficiency of the steambox 10 by retarding the loss of heat though all of the external walls of the steam plenum 31, except the wall 24 which directly opposes the sheet 8. The steambox plenum 31 is divided, for example, at 6 inch intervals along the cross-direction into steam chambers 32; steam enters these chambers 32 via steam valves 42 and headers 44. Details of the valves 42 are not taught herein and can be ascertained from U.S. Pat. No. 4,580,355, incorporated herein by reference. Other known types of valves are also suitable. One steam valve 42 controls the flow of steam into each associated chamber 32.

Figure 1:
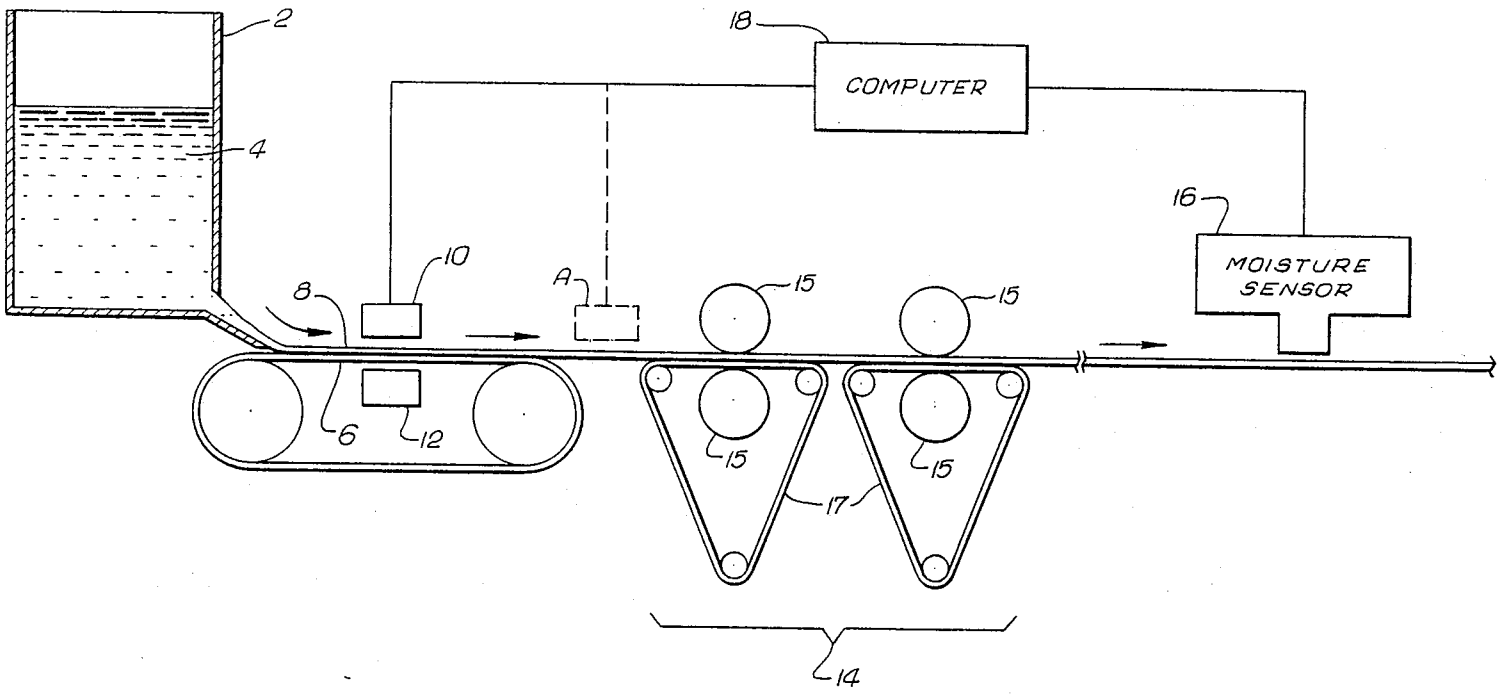
FIG. 1 is a schematic view of a paper-making machine including a steambox which may be designed according to the present invention, and suggested locations for same.

One aspect of the preferred embodiment of the invention is a single steam exit slot 46 which extends in the cross-direction across the lower wall 24 of the steambox 10, said wall 24 facing a paper sheet 8 in a papermaking machine, such as the example illustrated in FIG. 1. For the purpose of clarity, this wall 24 shall be referred to as the "face plate" 24. All external walls of the steambox are insulated, but not the face plate 24. The advantages of utilizing a non-insulated face plate 24 with a single, cross-directionally oriented steam exit slot 46 include the following. First, as previously mentioned, if steam is ejected through a single opening, as opposed to several small ones, the surface area of the steam exposed to ambient air is much less than that exposed when numerous openings are used to jet an equivalent volume of steam into a sheet. As a result, steam ejected from the slot 46 entrains less ambient air, does not cool down as rapidly and is therefore more effective at heating the sheet. Second, the lack of insulation on the inside surface of this face plate 24 permits the steam inside the plenum to keep this face plate hot. The hot face plate 24 produces less condensation thereupon. Third, use of a single slot 46 reduces the number of openings on the face plate 24 from which condensate could drip from the plenum 31 onto the sheet 8. Fourth, in the manufacture of the slot 46 in the face plate 24, the sheet metal forming the face plate 24 can be bent into the interior of the plenum. The bent portions, called "dams" 64, prevent steam which has condensed inside the plenum 31 from dripping out of the plenum 32 and onto the sheet 8. The use of a single slot 46 also results in simpler and far less expensive construction than would be required if numerous small holes with surrounding dams were fabricated.

A second component of the invention is a structure 48 angled atop the steam exit slot 46, which structure functions to deflect drippage from within the plenum 31 and keep the drops from exiting the slot 46. In the illustrated embodiment, this angled structure 48 (the "umbrella") is integrally formed with the posterior of a dam wall 64 inside the plenum chamber 32. While the umbrella 48 does not close off the slot 46 or obstruct the ejection of steam therefrom, the umbrella 48 does prevent condensed steam on the interior surfaces of the plenum 31 from dripping onto the paper sheet 8. The angle of the umbrella 48 may be adjusted to conform to the particular needs or requirements of a manufacturing process, provided the umbrella 48 inhibits dripping onto the sheet 8. In particular, as shown in FIG. 3, the umbrella 48 within the plenum chamber 32 should be angled away from the nozzle 60 to thereby shield the steam exit slot 46 from water drops ejected from the nozzle 60.

A third component of the invention is a system of drains 50 located anteriorly and posteriorly to the steam exit slot 46 within the plenum chambers 32. These drains 50 function to capture and remove condensation that forms within the plenum chambers 32. Thus, the drains 50, working in tandem with the dams 64 and umbrella 48, greatly reduce or completely prevent the drippage of condensate from within the chambers 32 onto the paper sheet 8. The drains illustrated in FIGS. 2–3 are simply circular holes cut in the sheet metal walls dividing the steam plenum 31 into various chambers 32. Tubing 33 is provided in the exterior side walls of the plenum 31 to allow the condensate to be drained away to a suitable location.

To further improve the effectiveness of the invention and to prevent condensation of excess steam on structures adjacent to the steam treatment zone defined by the face plate 24 of the steambox 10 and the paper surface 8, as condensation would otherwise adversely affect the papermaking process, a suction device may also be provided as part of the inventive steambox 10 to remove excess steam which would otherwise escape from the steam treatment zone.

As shown in FIG. 3, a vacuum plenum 52 may be provided within the steambox 10, separated from the steam chambers 32 by an insulated wall 62. The vacuum plenum 52 shown has an opening 54 at the trailing edge 56 of the steambox 10 and the opening 54 is in the form of a single slot 54 spanning the entire cross-direction of the face plate 24, as shown in FIGS. 2 and 3. This slot is known as a "scavenger" slot 54. Excess steam that has reached the trailing edge 56 of the steambox 10 is sucked into the vacuum plenum 52 via the scavenger slot 54 and out of the steambox 10 through a vacuum or exhaust pipe 28. The vacuum suction confines the steam within the steam treatment zone to prevent undesirable condensation of excess steam on adjacent surfaces. In addition, the vacuum suction facilitates the flow of steam from the steam exit slot 46 toward the trailing edge 56 of the steambox 10, as the steam deflects back and forth between the paper surface 8 and the face plate 24 as the paper moves along in the direction of arrow 70 (FIG. 3).

As the steam travels along the face plate 24, any condensation on the exterior surface of the face plate 24 may also be sucked into the vacuum plenum 52. The suction through the scavenger slot 54 diverts steam away from adjacent surfaces of the papermaking machine which otherwise would condense on those surfaces. To facilitate the flow of steam out of the vacuum plenum 52, the steam is maintained in a gaseous state in the vacuum plenum 52 by minimizing heat loss through the external walls of the plenum 52. Insulation material 40, such as fiberglass, is applied to the inside of the walls of the vacuum plenum 52. In addition, any condensation that forms within the vacuum plenum 52 is captured by drains 58 on both sides of the scavenger slot 54. The scavenger slot 54 is also bounded by dam walls 64 and an umbrella 48 to prevent drippage onto the sheet 8 of any steam which may condense inside the vacuum plenum 52.

In operation, steam fills each chamber 32, heating the face plate 24, exiting the steam slot 46 and impinging upon the paper sheet 8, as illustrated by the arrows in FIG. 3. The portion of the steam not immediately absorbed by the paper is deflected back and forth between the paper surface 8 and the face plate 24 (arrows 25) as the steam moves downstream in the direction of the paper movement. Each time the steam hits the paper surface 8, some steam is absorbed by the paper. Thus, the steam discharged through the steam exit slot 46 is able to treat a large area of the paper surface. As shown, the steam chambers 32 are located just inside of the face plate 24, so that the face plate 24 forms the external wall of each chamber 32. In this configuration, the steam in the chambers 32 keeps the face plate 24 hot to prevent condensation of the steam on the face plate 24.

It can be seen that by means of the plurality of valves 42 spaced at intervals in each chamber 32 across the span of the steambox 10, the amount of steam applied to the paper surface 8 may be controlled to vary by a desired amount in the cross-direction. A desired steam distribution profile in the cross-direction may be achieved by selectively controlling each steam valve 42 assocated with each chamber 32. Consequently, since the moisture content of the paper may be altered by the amount of steam applied to the paper surface 8, the moisture content of each section of the paper surface corresponding to each chamber 32 of the steambox 10 in the cross-direction may be controlled by supplying the appropriate amount of steam through the valves 42. Note, however, that it does not necessarily follow that, when different amounts of steam are supplied to the different chambers and hence to different sections of the paper surface, the moisture profile in the cross-direction will not be uniform. In a situation where a uniform moisture profile in the cross-direction is desired, it may be necessary to discharge different amounts of steam through each valve 42 in order to compensate for other variables in the papermaking system.

It is apparent that by increasing the number of chambers 32 and associated steam valves 42, that is, increasing the number of corresponding sections of the paper surface in the cross-direction by decreasing the size of each chamber 32, the resolution of the control of the moisture profile may be improved.

As shown in FIG. 1, a computer 18 may be employed to maintain a uniform moisture content or a predetermined moisture content in the paper sheet 8 by controlling the valves 42 (shown in FIG. 3) based upon the signals from the moisture sensor 16. The computer 18 receives signals from the moisture sensor 16 and can then compare the moisture content of the sheet to a desired moisture content. Based upon the determined deviation in the measured moisture content of the paper sheet 8 from the desired moisture content, the computer 18 will then selectively transmit control signals to the steam valve actuators 66 adjust (shown in FIG. 3) in the steambox 10 which in turn adjust the associated steam valves 42 so that the valves 42 discharge more or less steam through the nozzles 60 so as to provide the desired moisture profile.

Typically, if the moisture sensor 16 detects a higher moisture content than desired in a section of the paper sheet 8, the computer 18 adjusts the valve 42 in the chamber 32 adjacent to that sheet section and allows more steam to be applied to that section. As a result, the moisture content of that section of the paper sheet 8 is reduced because the temperature of that section is increased. As previously explained, the increased temperature decreases the viscosity of the water in that section. The hotter, less viscous water is more effectively removed from the sheet and the sheet section is therefore relatively drier. Alternatively, when the moisture sensor 16 detects a lower moisture content than desired in a particular sheet section, less steam is applied to that section.

In summary, the present invention provides a steambox for controllng the moisture profile across a sheet by selectively directing varying amounts of steam against cross-directional sections of the sheet. The design has a high heating efficiency resulting from the use of a single, cross-directional steam exit slot. Also, the amount of drippage from the apparatus is reduced or eliminated through the use of dams and umbrellas for preventing condensation inside the plenum from dripping onto the sheet and drains for draining away condensate from inside the steambox plenum 31.

One preferred embodiment of the present invention has been described. Nevertheless, it will be understood that various modifications may be made without departing from the spirit and scope of the invention. For example, the overall shape of the steambox need not be precisely rectangular; i.e., the face plate may be angled or curved instead of straight across so as to best conform to the shape of the adjacent sheet surface. Also, a working fluid other than steam may be employed without departing from the principles of the present invention. Moreover, the invention is not limited to use with paper. The invention may be used with other materials. Furthermore, it is expecially preferred to use a single steam exit slot since, as explained above, this will result in a minimal amount of entrained air and more efficient construction. However, the use of a limited number of slots is also within the scope of the invention, since a limited number of slots will result in less entrained air than the large number of holes used in prior art diffuser plates, though to a lesser extent than a single slot. For example, in certain circumstances it may be convenient to form one cross-directionally elongated slot for each steam chamber. Accordingly, it is to be understood that the invention is not to be limited by the specific illustrated embodiment, but only by the scope of the appended claims.

We claim:

1. A device for directing a flow of condensable gas toward a moving sheet surface, comprising:

a chamber for containing the condensable gas, the chamber having a wall means adapted to oppose the sheet surface and a gas exit slot having a length extending across the wall means, wherein the wall means is in close proximity to the sheet surface for a sufficient distance in the direction of sheet movement so that the condensable gas not immediately absorbed by the sheet is deflected back and forth between the sheet surface and the wall means as the condensable gas moves downstream in the direction of sheet movement;

a valve associated with the chamber for selectively controlling the flow of the condensable gas into the chamber; and dam means located downstream from the valve for substantially preventing condensate from dripping out of the chamber.

2. The device of claim 1, further comprising drainage means in the chamber for removing condensate from within the chamber.

3. The device of claim 1, wherein the dam means comprises a first member disposed adjacent to one side of the slot and a second member disposed adjacent to the other side of the slot, both the first and second members extending into the chamber along the entire length of the slot to substantially prevent condensate from dripping out of the chamber.

4. The device of claim 1, wherein the wall means is a bottom wall of the chamber.

5. The device of claim 1, further comprising a sheet opposite the wall means.

6. The device of claim 1, wherein the slot is disposed near to one end of the chamber measured perpendicularly to the slot.

7. The device of claim 3, wherein a distal end of the first member extends directly over the slot.

8. A system for directing a condensable gas toward a moving sheet for controlling an amount of moisture in the sheet, comprising:

an elongated plenum, having a leading edge and a trailing edge, and a wall means extending from the leading edge to the trailing edge so that the gas not immediately absorbed by the sheet is deflected back and forth between the sheet surface and the wall means as the gas moves downstream in the direction of sheet movement, wherein the wall means of the plenum is disposed adjacent to and faces the sheet, conforms to the shape of the sheet surface, and extends across the width of the sheet in the cross-direction, the plenum having a gas exit slot having a length extending along the wall means of the plenum facing the sheet, the gas exit slot being located, relative to the direction of sheet travel, in close proximity to the leading edge of the plenum; and pressurizing means for pressurizing the plenum with the gas such that the gas is jetted out of the exit slot and impinges on the sheet.

9. The system of claim 8, wherein the slot extends across a substantial portion of the entire width of the sheet.

10. The system of claim 4, further comprising:

at least one member disposed inside the plenum dividing the plenum into chambers on each side of the member, such that each chamber is shorter in the cross-direction than the plenum, and wherein the pressurizing means is a means for selectively pressurizing each plenum chamber with the gas.

11. The system of claim 10, further comprising:

a moisture sensor, disposed adjacent to the sheet and spaced from the plenum in the direction of movement of the sheet, for sensing the moisture content of the sheet and producing signals indicative of the sheet moisture content; and a computer operatively coupled to the moisture sensor and the pressurizing means for receiving the signals from the moisture sensor and controlling the pressurizing means to selectively pressurize each plenum chamber in response to the moisture sensor signals.

12. The system of claim 11, further comprising dam means for substantially preventing condensed gas from dripping out of the plenum chambers.

13. The system of claim 12, further comprising drainage means in the chamber for removing condensate from within the chamber.

14. The system of claim 13, wherein the dam means comprises a first member disposed adjacent to one side of the slot and a second member disposed adjacent to the other side of the slot, both the first and second members extending into the chamber along the entire length of the slot to substantially prevent condensed gas from dripping out of the plenum chambers.

15. The system of claim 4, wherein the slot extends across substantially the entire width of the sheet.

16. The system of claim 12, further comprising a vacuum plenum having a scavenger slot for suctioning gas escaping from the gas exit slot, wherein the scavenger slot is disposed on the same side of the sheet as the gas exit slot and spaced from the gas exit slot in the direction of sheet movement.

17. The system of claim 10, further comprising dam means for substantially preventing condensed gas from dripping out of the plenum chambers.

18. The system of claim 17, further comprising drainage means in the chambers for removing condensate from within the chamber.

19. The system of claim 18, wherein the dam means comprises a first member disposed adjacent to one side of the slot and a second member disposed adjacent to the other side of the slot, both the first and second members extending into the chamber along the entire length of the slot to substantially prevent condensed gas from dripping out of the plenum chambers.

20. The system of claim 19, wherein a distal end of the first member extends directly over the slot.

21. The system of claim 14, wherein a distal end of the first member extends directly over the slot.

22. The system for directing a flow of condensable gas toward a web surface, comprising:

a plenum for containing the condensable gas, wherein the plenum has a gas exit opening disposed in a lower wall thereof;

a valve associated with the plenum for controlling the flow of the condensable gas into the plenum; and umbrella means, substantially shielding the opening, for preventing condensate in the plenum from escaping through the opening an dripping on the web.

23. The system of claim 22, wherein the gas exit opening is slot extending across a width of the plenum.

24. A system for controlling the amount of moisture in a sheet material, comprising:

an enlongated plenum, wherein the plenum is disposed adjacent to the sheet and extends across the width of the sheet in a cross-direction, the plenum having at least one member disposed inside the plenum dividing the plenum into chambers on each side of the member, such that each chamber is shorter in the cross-direction than the plenum, the plenum having a fluid exit slot extending along a wall of the plenum facing the sheet, the slot extending across a substantial portion of the entire width of the sheet;

pressurizing means for selectively pressurizing each plenum chamber with a fluid such that the fluid is jetted out of the exit slot and impinges on the sheet;

dam means for substantially preventing condensed fluid from dripping out of the plenum chambers, comprising a first member disposed adjacent to one side of the slot and a second member disposed adjacent to the other side of the slot, both the first and the second members extending into the chamber along an entire length of the slot, the distal end of the first member extending directly over the slot; and drainage means in the chamber for removing condensate from within the chamber.

25. A system for controlling the amount of moisture in a moving sheet material, comprising:

an elongated plenum, wherein the plenum is disposed adjacent to the sheet and extends across the width of the sheet in a cross-direction, the plenum having at least one member disposed inside the plenum dividing the plenum into chambers on each side of the member, such that each chamber is shorter in the cross-direction than the plenum, the plenum having a fluid exit slot extending along the wall of the plenum facing the sheet, the slot extending across a substantial portion of the entire width of the sheet;

pressurizing means for selectively pressurizing each plenum chamber with a fluid such that the fluid is jetted out of the exit slot and impinges on the sheet;

dam means for substantially preventing condensed fluid from dripping out of the plenum chambers, comprising a first member disposed adjacent to one side of the slot and a second member disposed adjacent to the other side of the slot, both the first and the second members extending into the chamber along an entire length of the sot, the distal end of the first member extending directly over the slot;

drainage means in the chamber for removing condensate from within the chamber;

a moisture sensor, disposed adjacent to the sheet and spaced from the plenum in the direction of movement of the sheet, for sensing the moisture content of the sheet and producing signals indicative of the sheet moisture content; and a computer operatively coupled to the moisture sensor and the pressurizing means for receiving the signals from the moisture sensor and controlling the pressurizing means to selectively pressurize each plenum chamber in response to the moisture sensor signals.

* * * * *

UNITED STATES PATENT AND TRADEMARK OFFICE

CERTIFICATE OF CORRECTION

PATENT NO. : 4,977,687

DATED : December 18, 1990

INVENTOR(S) : Mathew G. Boissevain

It is certified that error appears in the above-identified patent and that said Letters Patent is hereby corrected as shown below:

Column 8:
In claim 10, line 55, after "claim" change "4" to --9--.
Column 9:
In claim 15, line 20, after "claim" change "4" to --8--.

In claim 22, line 45, before "system" change "The" to --A--.

Signed and Sealed this

First Day of February, 1994

Bruce Lehman

BRUCE LEHMAN

*Commissioner of Patents and Trademarks*

*Attest:*

*Attesting Officer*